US006945916B2

(12) United States Patent
Schroeder

(10) Patent No.: US 6,945,916 B2
(45) **Date of Patent: *Sep. 20, 2005**

(54) EXERCISE RESISTANCE DEVICE WITH MAGNETS

(75) Inventor: Duane G. Schroeder, New Hope, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/419,513

(22) Filed: Apr. 21, 2003

(65) Prior Publication Data

US 2003/0195089 A1 Oct. 16, 2003

Related U.S. Application Data

(63) Continuation of application No. 09/396,803, filed on Sep. 14, 1999, now Pat. No. 6,551,220.

(51) Int. Cl.[7] ..... A63B 69/16
(52) U.S. Cl. ..... 482/57; 482/58
(58) Field of Search ..... 482/51, 53, 57, 482/58, 60, 61, 63, 92, 110–113, 148, 903; 310/92, 93, 96, 97, 103–108; 74/574; 188/24.11, 267, 158, 164

(56) References Cited

U.S. PATENT DOCUMENTS

| | | | | | |
|---|---|---|---|---|---|
| 2,235,184 | A | | 3/1941 | Wettlaufer | 601/58 |
| 3,140,711 | A | | 7/1964 | McGathey | 601/49 |
| 3,961,213 | A | | 6/1976 | Koike et al. | 310/104 |
| 4,003,375 | A | | 1/1977 | Simjian | 128/54 |
| 4,958,831 | A | | 9/1990 | Kim | 272/73 |
| 5,248,245 | A | | 9/1993 | Behnke et al. | 417/366 |
| 5,716,331 | A | | 2/1998 | Chang | 601/50 |
| 5,722,916 | A | | 3/1998 | Goldberg | 482/57 |
| 5,762,584 | A | * | 6/1998 | Daniels | 482/5 |
| 5,944,637 | A | | 8/1999 | Stickler et al. | 482/61 |
| 6,551,220 | B1 | | 4/2003 | Schroeder | 482/57 |

FOREIGN PATENT DOCUMENTS

| | | |
|---|---|---|
| WO | WO 98/13108 | 4/1998 |
| WO | WO 99/10049 | 3/1999 |

* cited by examiner

*Primary Examiner*—Jerome W. Donnelly
*Assistant Examiner*—Tam Nguyen
(74) *Attorney, Agent, or Firm*—Westman, Champlin & Kelly, P.A.; Todd R. Fronek

(57) ABSTRACT

An exercise resistance device for use in an exercise apparatus includes a rotatable shaft and an impeller rotatable within a fluid filled sealed chamber. A rotating member is joined for rotation with the rotatable shaft. The rotating member is external to the sealed chamber and is magnetically coupled to the impeller.

13 Claims, 10 Drawing Sheets

EXERCISE RESISTANCE DEVICE WITH MAGNETS

CROSS-REFERENCE TO RELATED APPLICATION

The present application is continuation patent application of and claims priority of U.S. patent application Ser. No. 09/396,803, filed Sep. 14, 1999 U.S Pat. No. 6,551,220, the content of which is hereby incorporated by reference in its entirety.

BACKGROUND OF THE INVENTION

The present invention relates generally to a resistance device for use with exercise equipment and, more particularly, to a resistance device for bicycle trainers.

Bicycle trainers have been used by bicycle enthusiasts to convert their bicycles for stationary riding. A typical user is a bicycle owner who competes in various bicycles races or rides often. When the weather prevents riding outdoors, such as when it is raining, too cold, or too hot, the cyclist can use the trainer indoors to simulate a ride. In some cases, cyclists may want to use a trainer while also reading or watching television. However, in all cases, the bicycle trainer should be easy to use and simulate bicycle riding on the open road.

A common bicycle trainer has a frame onto which the user mounts the bicycle. Typically, the rear wheel of the bicycle is in contact with a roller that, in turn, is coupled to a resistance unit. The resistance unit provides increasing resistance to match the energy output of the rider. Some resistance devices use fluid as a resistance medium. However, a significant problem of current fluid resistance units is that they can leak, which can damage or stain the surface upon which it rests.

SUMMARY OF THE INVENTION

An exercise resistance device for use in an exercise apparatus includes a rotatable shaft and an impeller rotatable within a fluid filled sealed chamber. A rotating member is joined for rotation with the rotatable shaft. The rotating member is external to the sealed chamber and is magnetically coupled to the impeller.

DETAILED DESCRIPTION OF THE ILLUSTRATIVE EMBODIMENTS

Figure 2:
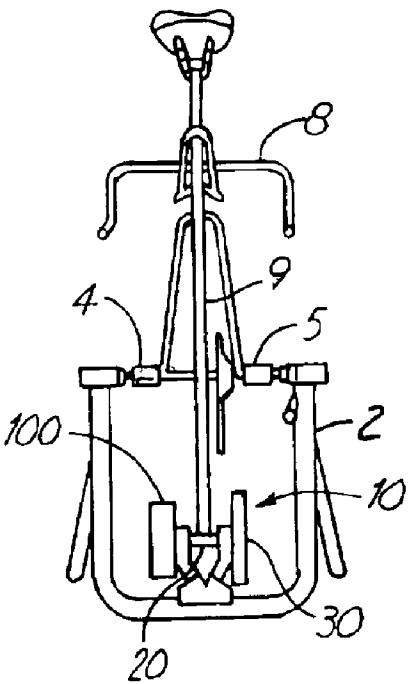
FIG. 2 is a front elevational view of the trainer with a bicycle.
Figure 1:
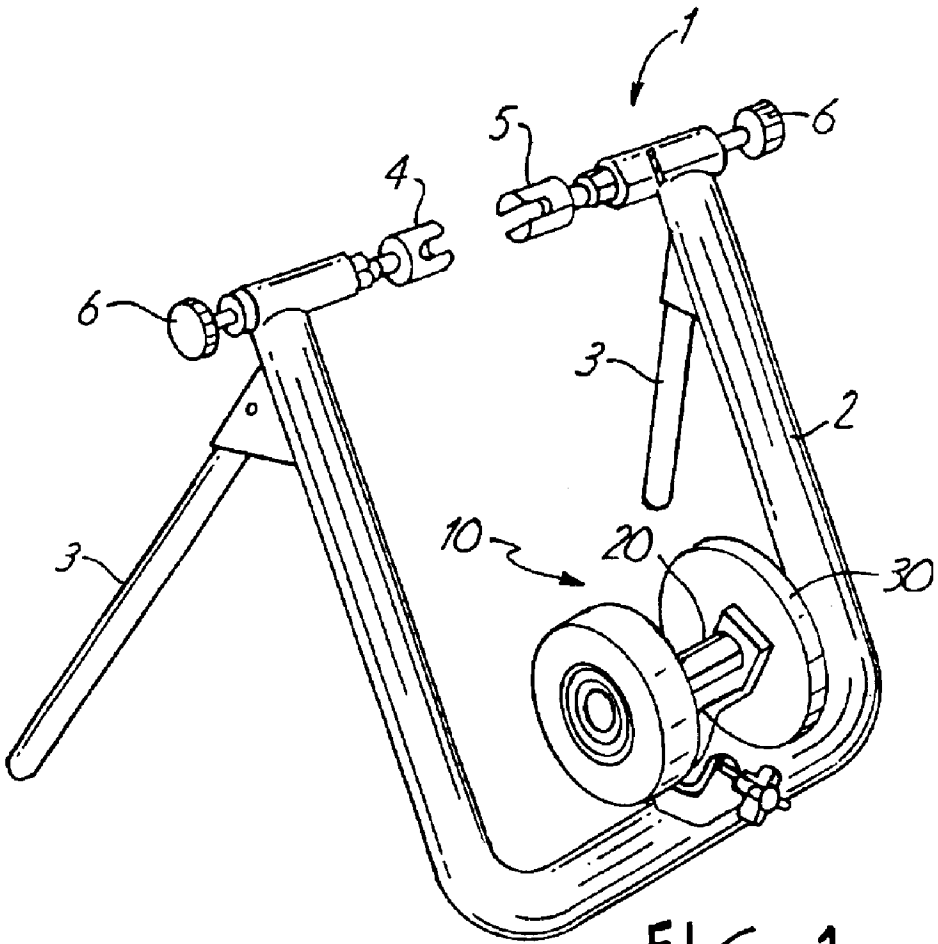
FIG. 1 is a perspective view of a bicycle trainer.

FIG. 1 illustrates a bicycle trainer 1 having a U-shaped frame 2 and legs 3. The legs 3 can fold in towards frame 2 to allow bicycle trainer 1 to be easily stored. Referring also to FIG. 2, a rear wheel 9 of a bicycle 8 is held in place by clamps 4 and 5. Handles 6 are provided to move the clamps 4 and 5 to engage the bicycle 8 and hold it upright.

A resistance unit is shown generally at 10. In the embodiment illustrated, the resistance unit 10 includes a roller or a shaft 20 that is coupled to a flywheel 30 and an impeller unit 100 on opposite sides thereof. The rear wheel 9 of the bicycle 8 is in friction contact with the roller 20. It should be noted that the frame 2, the legs 3 and the clamps 4 and 5 are but one suitable embodiment wherein other frame configurations can be used to maintain the bicycle 8 and rider in a stable, upright position.

Figure 3:
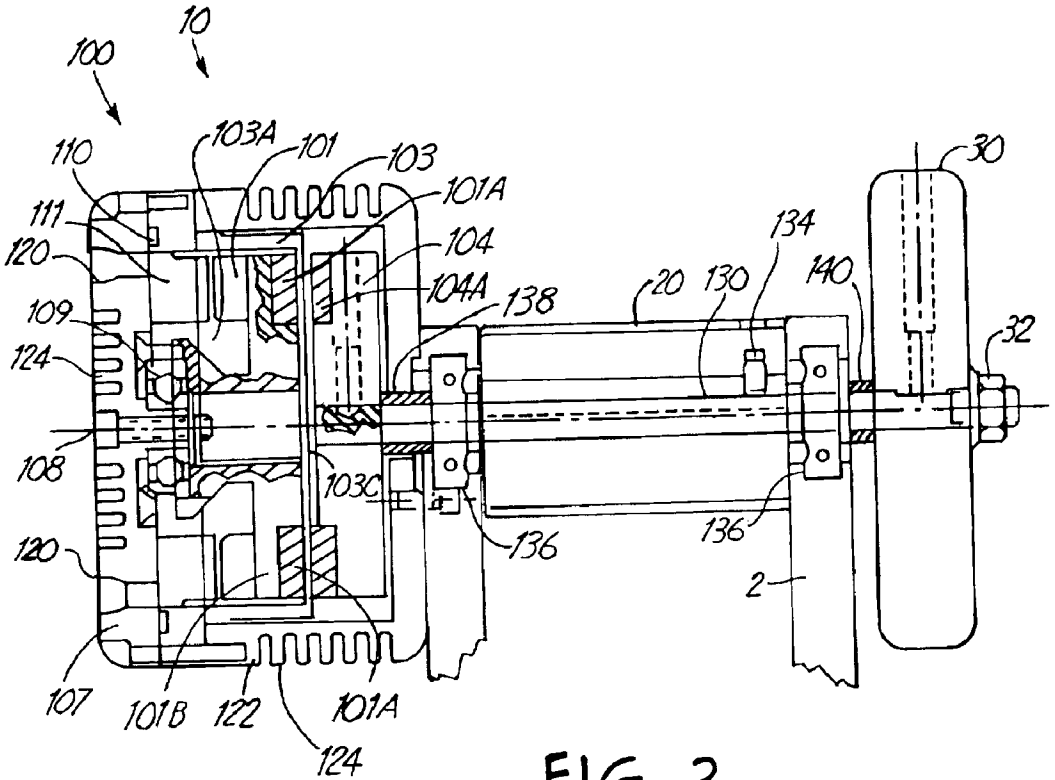
FIG. 3 is a partial sectional view of a resistance device.
Figure 4:
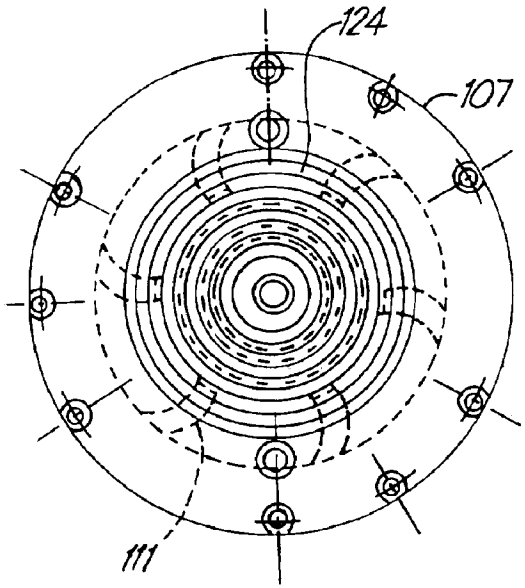
FIG. 4 is a plan view of a cap.
Figure 7:
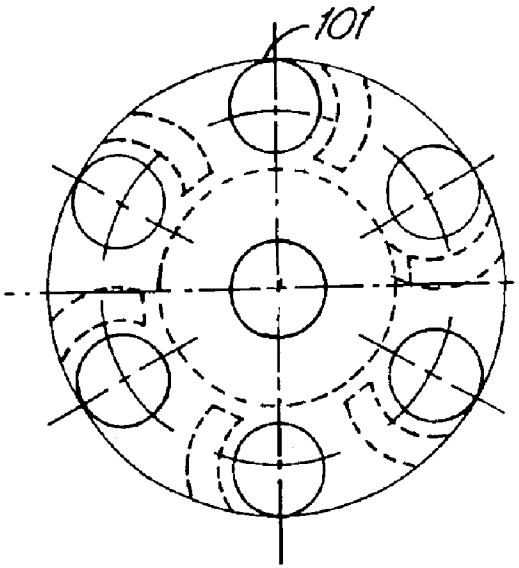
FIGS. 5–7 are views of an impeller.
Figure 6:
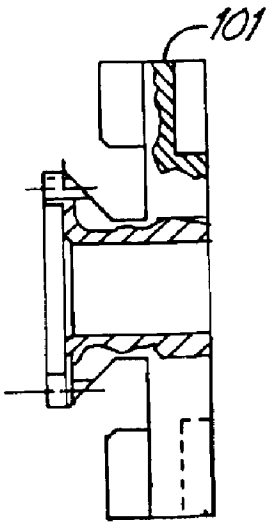
Figure 5:
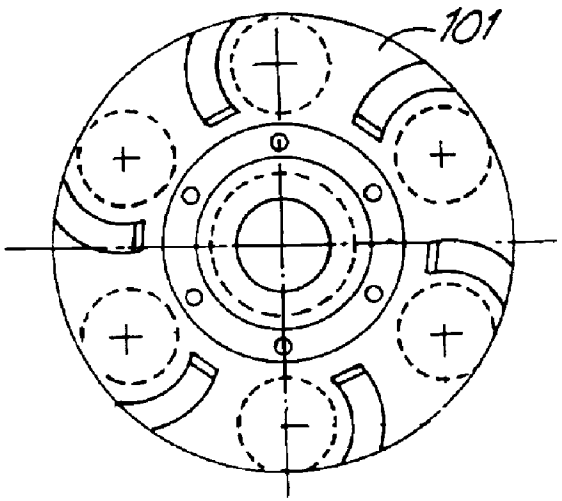
Figure 9:
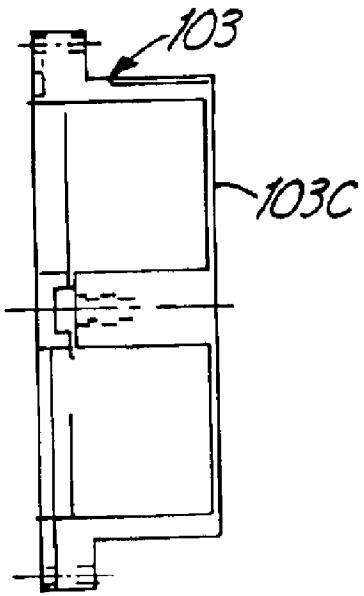
FIGS. 8–9 are views of a wall structure for forming a sealed chamber.
Figure 8:
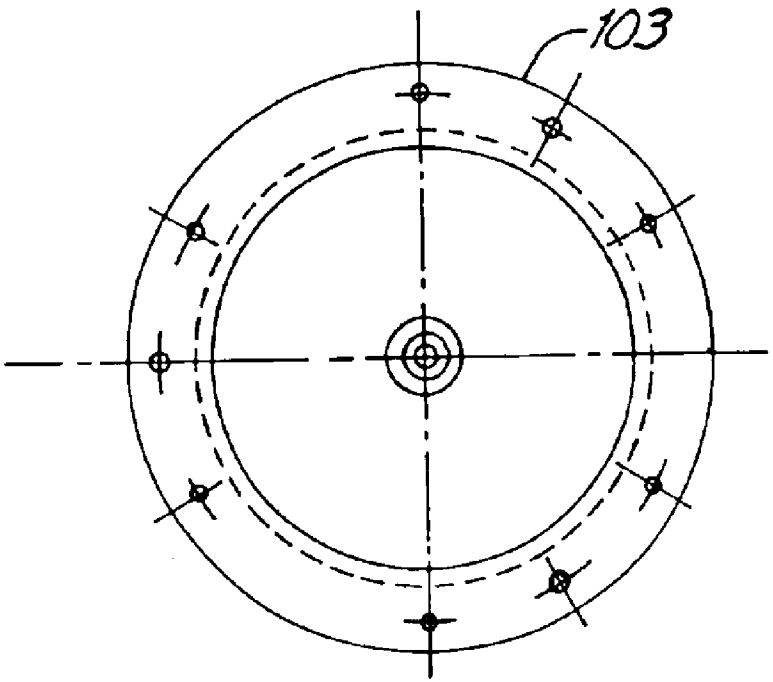
Figure 12:
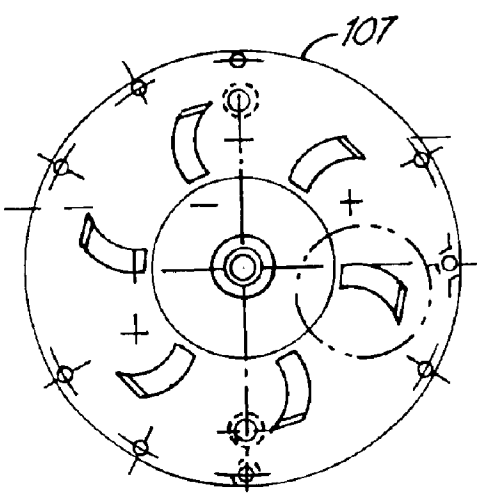
FIGS. 10–12 are views of the cap.
Figure 11:
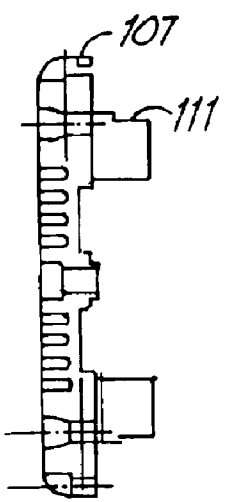
Figure 10:
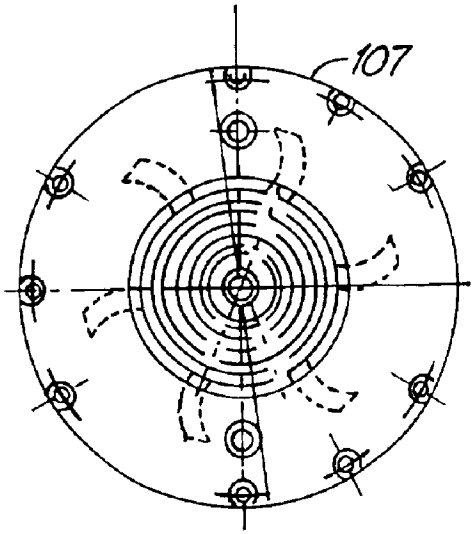
Figure 14:
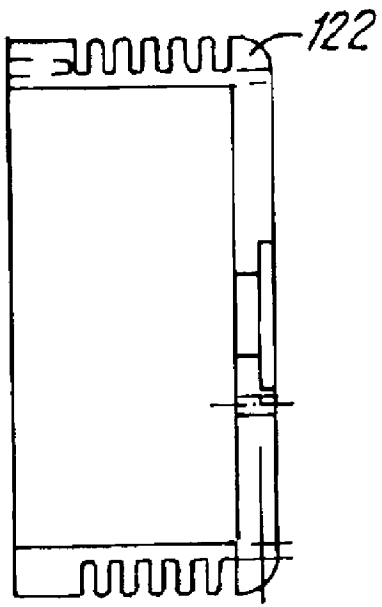
FIGS. 13 and 14 are views of an outer housing.
Figure 13:
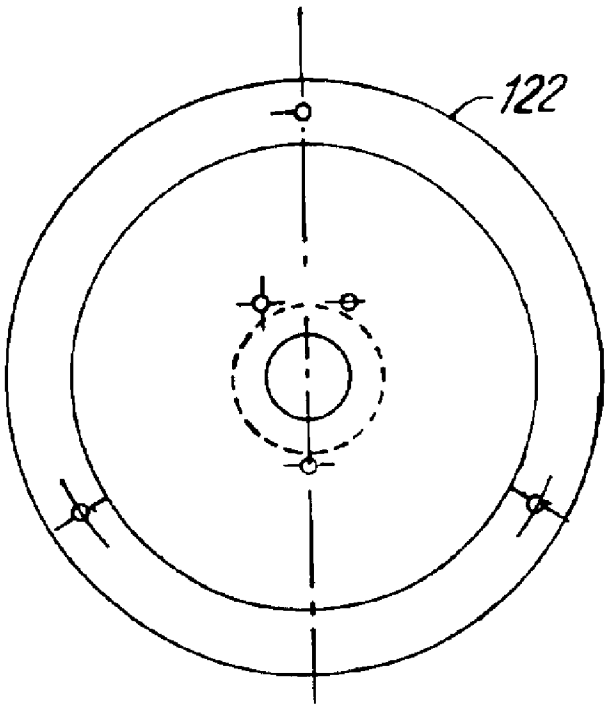
Figure 16:
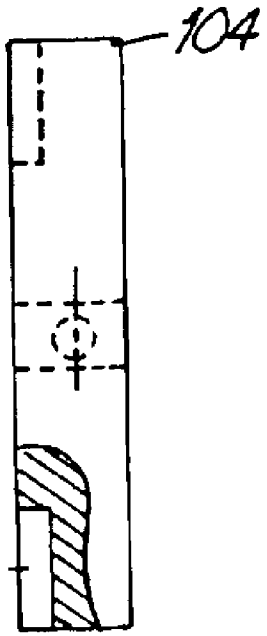
FIGS. 15 and 16 are views of a rotating member.
Figure 15:
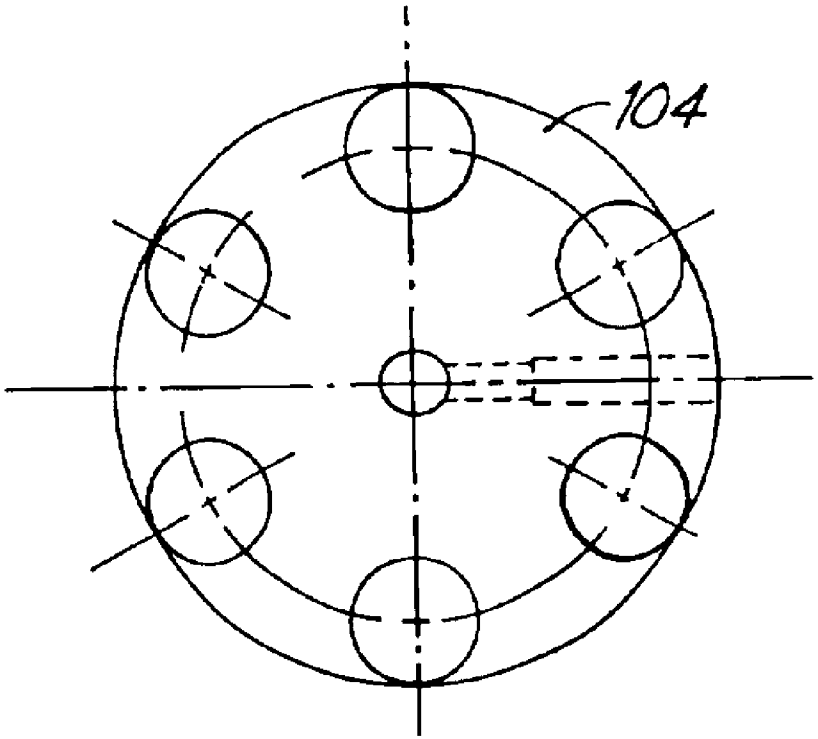
Figure 18:
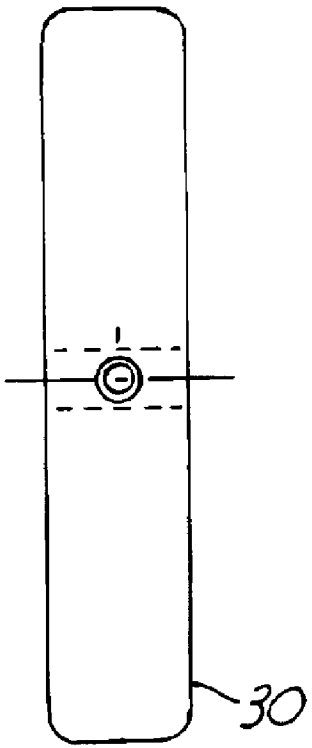
FIGS. 17 and 18 are views of a flywheel.
Figure 17:
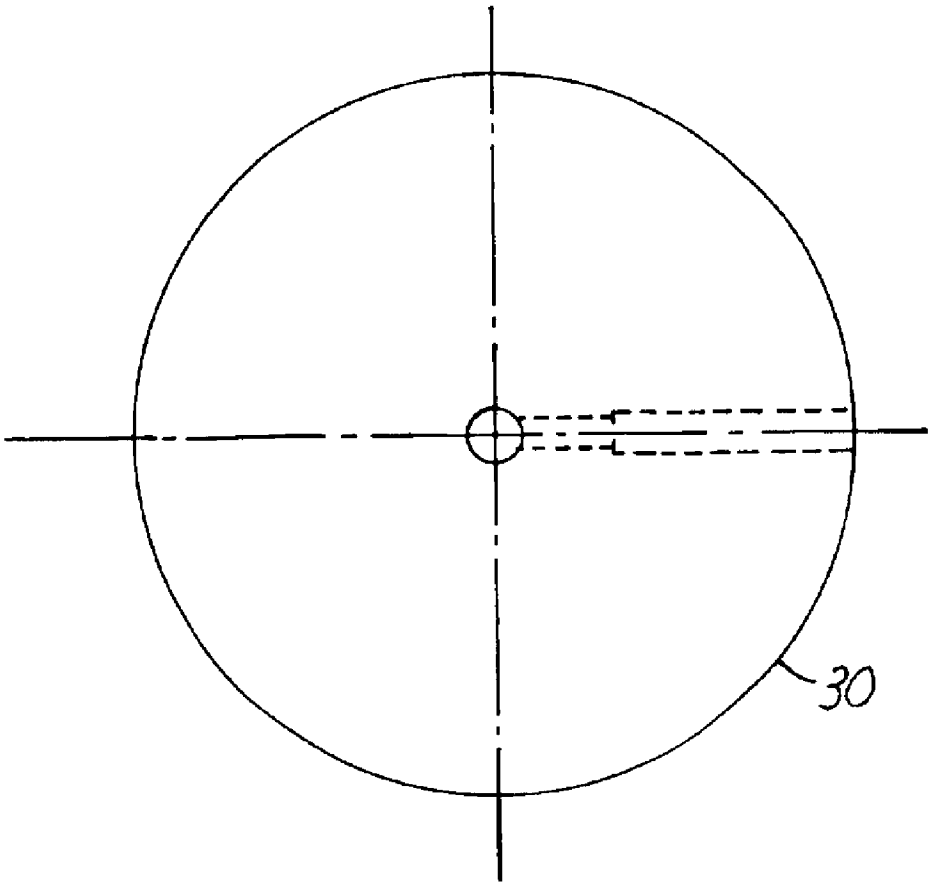

Referring to FIG. 3, the impeller unit 100 includes an impeller 101 located within enclosed chamber walls 103, forming a sealed chamber 103A. External to the chamber 103A, but magnetically coupled to the impeller 101, is a rotating member 104 that is directly coupled to the roller 20 to rotate therewith. The flywheel 30 is also provided and coupled to the roller 20 to rotate therewith, if needed.

The impeller 101 is disposed within the chamber 103A to rotate therein. In the embodiment illustrated, at least one and preferably a plurality of magnets 101A are secured to or molded within the impeller 101 on a disk portion 101B thereof. Similarly, at least one and preferably a plurality of magnets 104A are provided on the rotating member 104 or molded therein. In one embodiment, the plurality of magnets 101A and 104A are spaced approximately 0.110 inches apart. However, a wall portion 103C, partially defining the chamber 103A, extends between the impeller 101 and the rotating member 104. The wall portion 103C can be formed from a non-magnetic material, such as plastic, fiberglass or ceramic. In the example provided above, where the magnets are 0.110 inches apart, the wall portion 103C can be 0.06 inches thick.

The impeller 101 is mounted within the chamber 103A so as to rotate therein. In the embodiment illustrated, the impeller 101 is mounted to a cap 107 with a mounting bolt 108 and a bearing 109. The cap 107 is joined to the chamber walls 103 and sealed therewith using an O-ring seal 110 to form the sealed chamber 103A. A stationary vane assembly 111 is provided in the chamber 103A, for example, integrally formed with the cap 107. Ports 120 are provided to fill the chamber 103. A fluid, such as silicone (e.g., having a viscosity approximately equal to 50 centistrokes) is provided in the chamber 103A to provide resistance between the impeller 101 and the vane assembly 111. The amount of fluid within the chamber 103A can be varied to change the resistance. In addition, the number of vanes on the vane assembly 111 and the impeller 101 can be varied to obtain the desired resistance.

In the embodiment illustrated, an outer housing 122 is joined to the chamber walls 103 to enclose the rotating member 104. Fins 124 can be provided on the outer housing 122 and the cap 107 for cooling purposes.

In the embodiment illustrated, although other configurations can be used, a center shaft 130 extends from the rotating member 104 to the flywheel 30 and is secured thereto with a nut 32. The roller 20 is coupled to rotate with the shaft 130 using a setscrew 134. Bearings 136 are provided to allow the shaft 130 to rotate on the frame 2. Spacer bushings 138 and 140 are provided between the shaft 130 and the housing 122, and the shaft 130 and the flywheel 30, respectively.

The resistance unit 10 described herein provides a sealed chamber 103A wherein the impeller 101 can rotate therein, being driven by the rotating member 104 in a non-contact, magnetically coupled manner. In the embodiment illustrated, no rotating seals are used, but rather, a stationary seal is provided, for example, by the O-ring seal 110. The stationary seal significantly reduces the possibility of leaks.

FIGS. 4–18 are views of many of the components described above.

Figure 19:
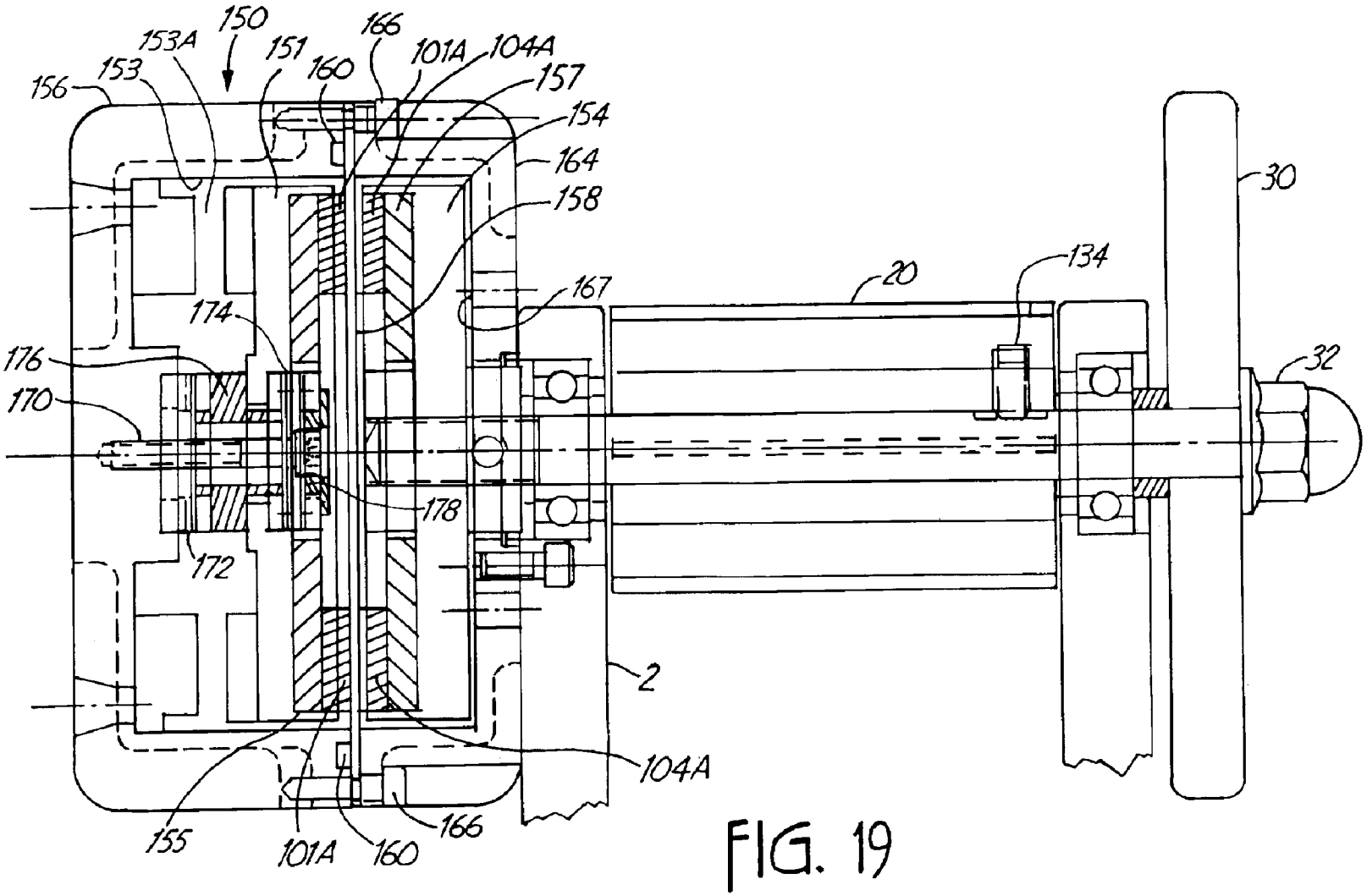
FIG. 19 is a partial sectional view of a second embodiment of a resistance device.
Figure 20:
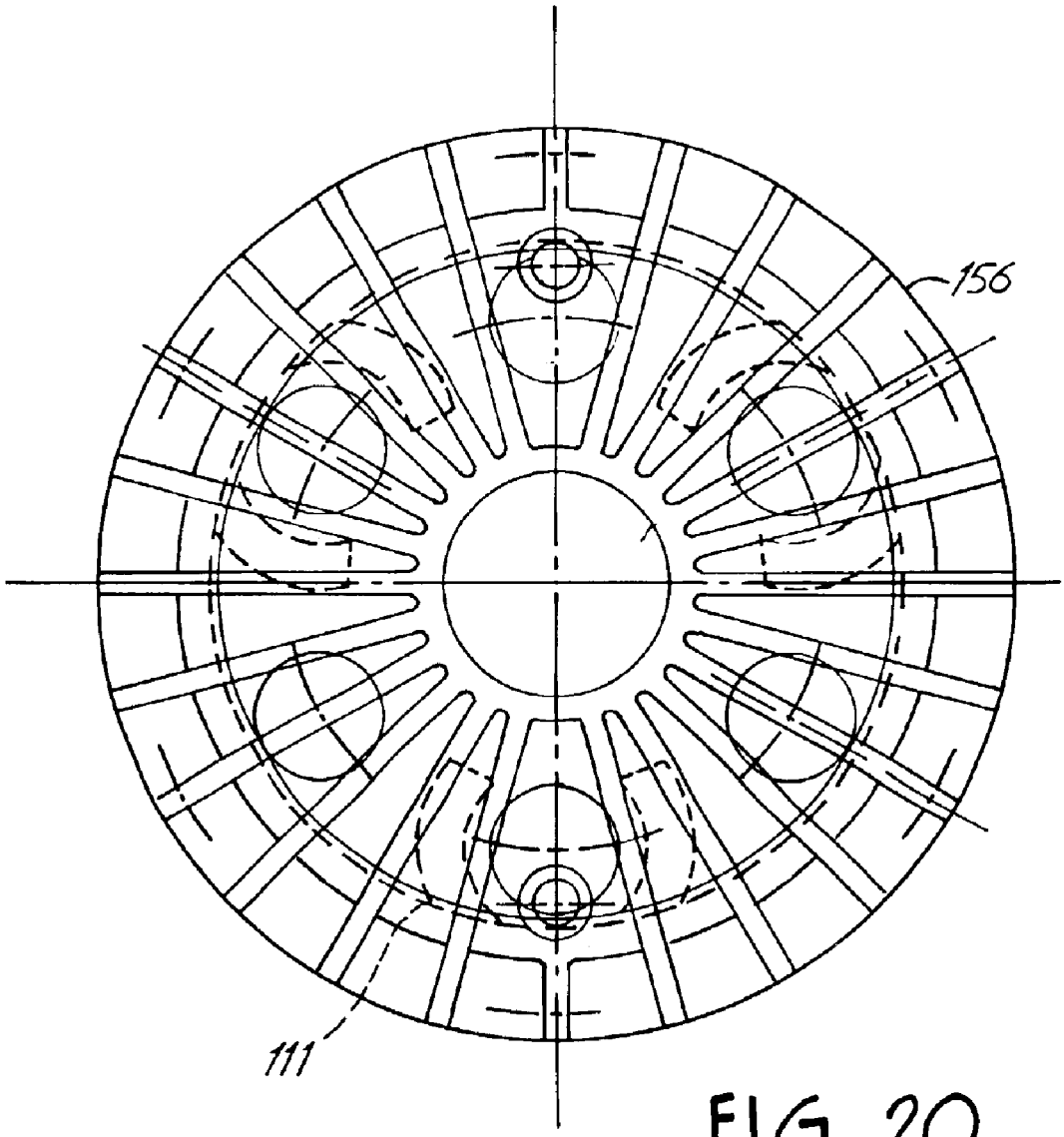
FIG. 20 is an end view of the second embodiment.

FIGS. 19 and 20 illustrate a second embodiment of an impeller unit 150. The impeller unit 150 includes an impeller 151 located within enclosed walls 153, forming a sealed chamber 153A. Like the impeller 101, the impeller 151 is magnetically coupled to a rotating member 154 that is directly coupled to the roller 20.

The impeller 151 can be formed from a high-permeability magnet material; however, in this embodiment, the plurality of magnets 101A are joined to a separate portion 155. As used herein "high-permeability magnetic material" shall mean a material used to concentrate magnetic flux from the magnets along a desired path. Commonly, such a material is ferromagnetic, for example, iron or steel, although other materials can also be used. The magnets 101A can be secured to the high-permeability magnetic material, herein embodied as a plate 155, using magnetic attraction although an adhesive such as available from the Loctite Corporation of Rocky Hill, Conn., can also be used. The rotating member 154 can be constructed in a similar manner with the plurality of magnets 104A secured to a high-permeability plate 157.

The enclosed walls 153 forming the sealed chamber 153A include a bowl portion 156 and a plate member 158. The bowl portion 156 includes the stationary vanes 111. The plate member 158 is held against a stationary seal 160 by a support portion 164 with a plurality of fasteners 166. The support portion 164 and the plate member 158 form a second chamber 167 in which the rotating member 154 rotates. The plate member 158 is non-magnetic and can be formed from plastic, fiberglass or ceramic. In one embodiment, the plate member 158 is formed from Garolite™ available from McMaster-Carr of Chicago, Ill. The plate member 158 is generally thin, for example, 0.060 inches wherein 0.030 spacing can be provided between the plate member 158 and the magnets 101A and 104A.

In this embodiment, the impeller 151 is secured to the bowl portion 156 using a fastener 170 with thrust bearings 172 and 174, spacer 176 and a washer 178. As illustrated in FIG. 20, three opposed sets of vanes are formed between the impeller 151 and the stationary vanes 111 although more or less vanes can be used on the impeller 151 and rotating member 154 as desired.

Although the present invention has been described with reference to preferred embodiments, workers skilled in the art will recognize that changes may be made in form and detail without departing from the spirit and scope of the invention.

What is claimed is:

1. A bicycle exercise resistance device comprising:

a support member;

a roller rotatable on the support member, the roller being adapted to engage a tire of a bicycle;

an impeller rotatable within a fluid filled sealed chamber;

a rotating member joined for rotation with the roller, the rotating member being external to the sealed chamber and magnetically coupled to the impeller;

at least one first magnet provided on the impeller and at least one second magnet provided on the rotating member; and a housing forming the sealed chamber, the housing including a bowl portion joined to a thin plate member that faces the rotating member and is disposed between the first and second magnets, the bowl portion and the thin plate member having a stationary seal formed therebetween.

2. The bicycle exercise resistance device of claim 1 wherein the seal comprises an o-ring.

3. The bicycle exercise resistance device of claim 1 and further comprising stationary vanes mounted to the housing and disposed in the sealed chamber.

4. The bicycle exercise resistance device of claim 3 wherein the stationary vanes are provided on the bowl portion and wherein the impeller is rotatably mounted to the bowl portion.

5. The bicycle exercise resistance device of claim 1, wherein the thin plate member is constructed of a non-magnetic material.

6. The bicycle exercise resistance device of claim 5, wherein the non-magnetic material comprises a ceramic material.

7. The exercise resistance device of claim 1, wherein the distance between the first and second magnets is approximately 0.120 inches.

8. The bicycle exercise resistance device of claim 7, wherein the thin plate member has a thickness of approximately 0.060 inches.

9. The exercise resistance device of claim 8, wherein the thin plate member is positioned approximately 0.030 inches from each of the first and second magnets.

10. A bicycle exercise resistance device comprising:

a support member;

a roller rotatable on the support member, the roller being adapted to engage a tire of a bicycle;

an impeller rotatable within a fluid filled sealed chamber, wherein the impeller includes a high-permeability magnetic material and at least one magnet; and a rotating member joined for rotation with the rotatable shaft, the rotating member being external to the sealed chamber and magnetically coupled to the impeller.

11. The bicycle exercise resistance device of claim 10 wherein the high-permeability magnetic material portion comprises a plate facing the rotating member, wherein the magnet is joined to the plate between the plate and the rotating member.

12. The bicycle exercise resistance device of claim 10 wherein the rotating member includes a second high-permeability magnetic material portion and at least one magnet.

13. The bicycle exercise resistance device of claim 10 wherein the second high-permeability magnetic material portion comprises a plate facing the impeller, wherein the magnet is joined to the plate between the plate and the impeller.

* * * * *